US006079757A

United States Patent [19]

Aubry

[11] Patent Number: 6,079,757

[45] Date of Patent: Jun. 27, 2000

[54] DOOR LATCH WITH MANUALLY RESETTABLE DEADBOLT LOCK

[75] Inventor: Michael Eugene Aubry, Shelby Township, Macomb County, Mich.

[73] Assignee: General Motors Corporation, Detroit, Mich.

[21] Appl. No.: 09/132,292

[22] Filed: Aug. 11, 1998

[51] Int. Cl.[7] ..... E05C 3/06

[52] U.S. Cl. ..... 292/201; 292/216

[58] Field of Search ..... 292/201, 216, 292/144, 280, DIG. 23, DIG. 26; 70/264, 277–282, 237–240

[56] References Cited

U.S. PATENT DOCUMENTS

| | | | |
|---|---|---|---|
| 5,192,103 | 3/1993 | Fukomoto et al. . | |
| 5,277,461 | 1/1994 | Dzurko | 292/216 |
| 5,474,340 | 12/1995 | Brackmann et al. . | |
| 5,577,583 | 11/1996 | O'Donnell | 292/336.3 |
| 5,583,282 | 12/1996 | Ikeda | 292/201 |
| 5,584,515 | 12/1996 | Silye | 292/201 |
| 5,715,713 | 2/1998 | Aubry | 70/277 |
| 5,887,466 | 3/1999 | Yoshizawa | 70/257 |
| 5,931,034 | 8/1999 | Fisher | 70/264 |

FOREIGN PATENT DOCUMENTS

| | | |
|---|---|---|
| 4343340 | 7/1994 | Germany . |
| 97/28337 | 8/1997 | WIPO . |

*Primary Examiner*—B. Dayoan
*Assistant Examiner*—Gary Estremsky
*Attorney, Agent, or Firm*—Kathryn A. Marra

[57] ABSTRACT

A door latch has an outside latch operating lever for unlatching the door latch, a composite locking lever that has an unlocked position where the outside latch operating lever is operable and a locked position where the outside latch operating lever is disabled; an inside lock operating lever for moving locking lever back and forth between the locked and unlocked positions and an outside lock operating lever for moving the locking lever back and forth between the locked and unlocked position; and a deadbolt locking mechanism for disabling the inside lock operating lever. The composite locking lever has an inside locking lever and an outside locking lever that includes the composite locking lever. The outside locking lever is operated by the outside lock operating lever and has an unlocked position where the outside latch operating lever is disabled. The deadbolt locking mechanism also includes a drive member that has a drive position that couples the inside and outside locking members for concurrent movement so that the inside locking member can move the outside locking member along with it from the locked position to an unlocked position where the outside latch operating lever is operable and a lost motion position where the inside locking member cannot move the outside locking member with it from the locked position to the unlocked position. The drive member is moved back and forth between the drive position and the lost motion position by a link that can be overridden by a reset member that is controlled by the outside latch operating lever.

11 Claims, 5 Drawing Sheets

DOOR LATCH WITH MANUALLY RESETTABLE DEADBOLT LOCK

TECHNICAL FIELD

This invention relates generally to an automotive door latch and more particularly to an automotive door latch that has a deadbolt lock (also known as a double lock) that prevents unauthorized entry into a locked vehicle by using an inside sill button or other operator inside the vehicle to unlock the door latch.

BACKGROUND OF THE INVENTION

An automotive closure, such as a door for an automobile passenger compartment, is hinged to swing between open and closed positions and conventionally includes a door latch that is housed between inner and outer panels of the door. The door latch functions in a well known manner to latch the door when it is closed and to lock the door in the closed position or to unlock and unlatch the door so that the door can be opened manually. The door latch is operated outside the automobile by two separate and distinct locking and latching operators. A key cylinder or remote transmitter controls the locking function, and a handle or push-button controls the latching function. The door latch is also operated inside the passenger compartment by two separate and distinct locking and latching operators. A sill button or electric switch controls the locking function, and a handle controls the latching function. Each operator is accessible outside the door structure and extends into the door structure where it is operatively connected to the door latch mechanism by an actuator assembly that is located inside the door structure.

U.S. Pat. No. 5,277,461 granted to Thomas A. Dzurko et al on Jan. 11, 1997 for a vehicle door latch, which is hereby incorporated in this patent specification by reference, discloses a typical door latch. The door latch disclosed in the Dzurko '461 patent includes an outside latch operating lever and an outside lock operating lever that are pivotally mounted on a stud along with a locking lever. The door latch can be unlocked by rotating the outside lock operating lever counterclockwise and then unlatched by rotating outside latch operating lever clockwise. The door latch also includes an inside latch operating lever and an inside lock operating lever latch that are pivotally mounted on a flange of a metal face plate near each other. The door latch can also be unlocked by rotating inside lever counterclockwise and then unlatched by rotating the inside latch operating lever clockwise.

Door latches of the type disclosed in the Dzurko '461 patent have been used successfully by General Motors Corporation for many years.

The purpose of the locking function, of course, is to prevent unauthorized entry into the automotive vehicle by locking the vehicle doors. However, unauthorized persons can enter locked automotive vehicles by gaining access to the sill button, electric switch or other operator inside the vehicle that controls the locking function of the door latch.

SUMMARY OF THE INVENTION

The object of this invention is to provide a door latch that has a deadbolt lock that disables an inside lock operating lever of the door latch so that a locked vehicle cannot be entered by gaining access to the sill button, electric switch or other operator inside the vehicle that controls the locking function of the door latch by breaking a window or using some sort of burglary tool.

A feature of the door latch of the invention is that the door latch includes an inside lock operating lever and a deadbolt lock that disables the inside lock operating lever so that the door latch cannot be unlocked from inside the vehicle when the deadbolt lock is engaged.

Another feature of the door latch of the invention is that the door latch includes a deadbolt lock and a reset lever that is manually operated to reset the deadbolt lock after use.

Still another feature of the door latch of the invention is that the door latch includes a deadbolt lock and a reset lever for the deadbolt lock that is manually operated by an outside door handle or push button.

These and other objects, features and advantages of the invention will become apparent from the description below, which is given by way of example with reference to the accompanying drawings.

DESCRIPTION OF THE PREFERRED EMBODIMENT

Figure 1:
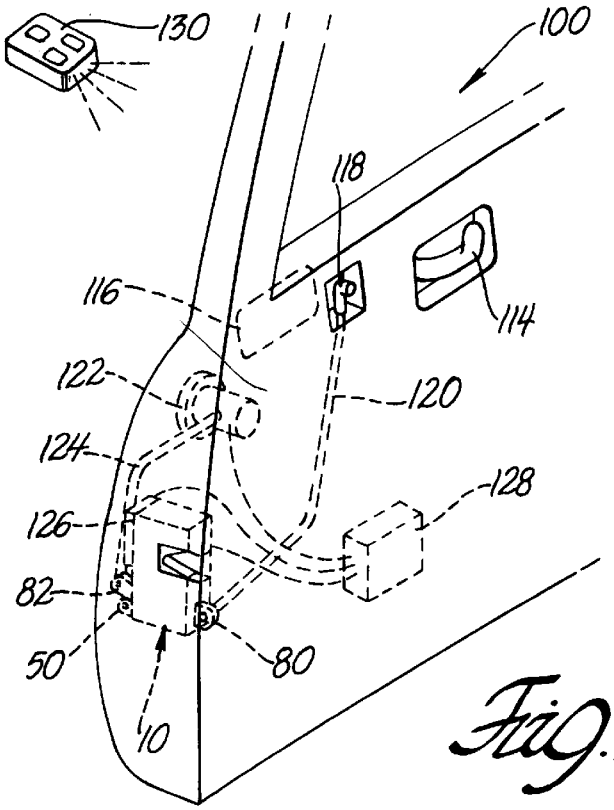
FIG. 1 is a perspective schematic view of a vehicle door that is equipped with a door latch that includes a deadbolt lock in accordance with the invention.

Referring now to FIG. 1, an automotive closure, such as a vehicle door, is generally indicated at 100. The vehicle door 100 is hinged to swing between open and closed positions in a conventional manner and includes a vehicle door latch generally indicated at 10. Door latch 10 includes a latching mechanism which upon closing of vehicle door 100 latches onto a strike member (not shown) mounted on the door jamb to retain the door 100 in the closed position. Strike members are well known in the art and hence the strike member has not been shown in the interest of clarity.

The latched door 100 can be reopened simply by unlatching door latch 10 via either an inside handle 114 or an outside handle 116 and swinging the door 100 to the open position.

Door latch 10 also includes a locking mechanism that disables the latching mechanism to prevent unauthorized entry into the vehicle. Door latch 10 is locked and unlocked by a locking mechanism that is controlled by an inside sill button 118 that is slideably mounted in the door and connected to door latch 10 by a control rod 120. Door latch 10 can be locked and unlocked from outside the vehicle in a well known manner by an inside electric switch (not shown) that controls a power lock actuator 126 that drives a linkage system (not shown) connected to door latch 10. Other inside operators, such as slides, are also known.

Door latch 10 is also locked and unlocked by an outside key cylinder 122 that is connected to door latch 10 by a control rod 124. Door latch 10 can also be locked and unlocked from outside the vehicle by a control module 128 that is operatively connected to the power lock actuator 126 and energized by a remote transmitter 130.

As indicated above, the vehicle door latch 10 is described in detail in U.S. Pat. No. 5,277,461 granted to Thomas A. Dzurko et al on Jan. 11, 1997 for a vehicle door latch that has been incorporated in this patent specification by reference.

Figure 3:
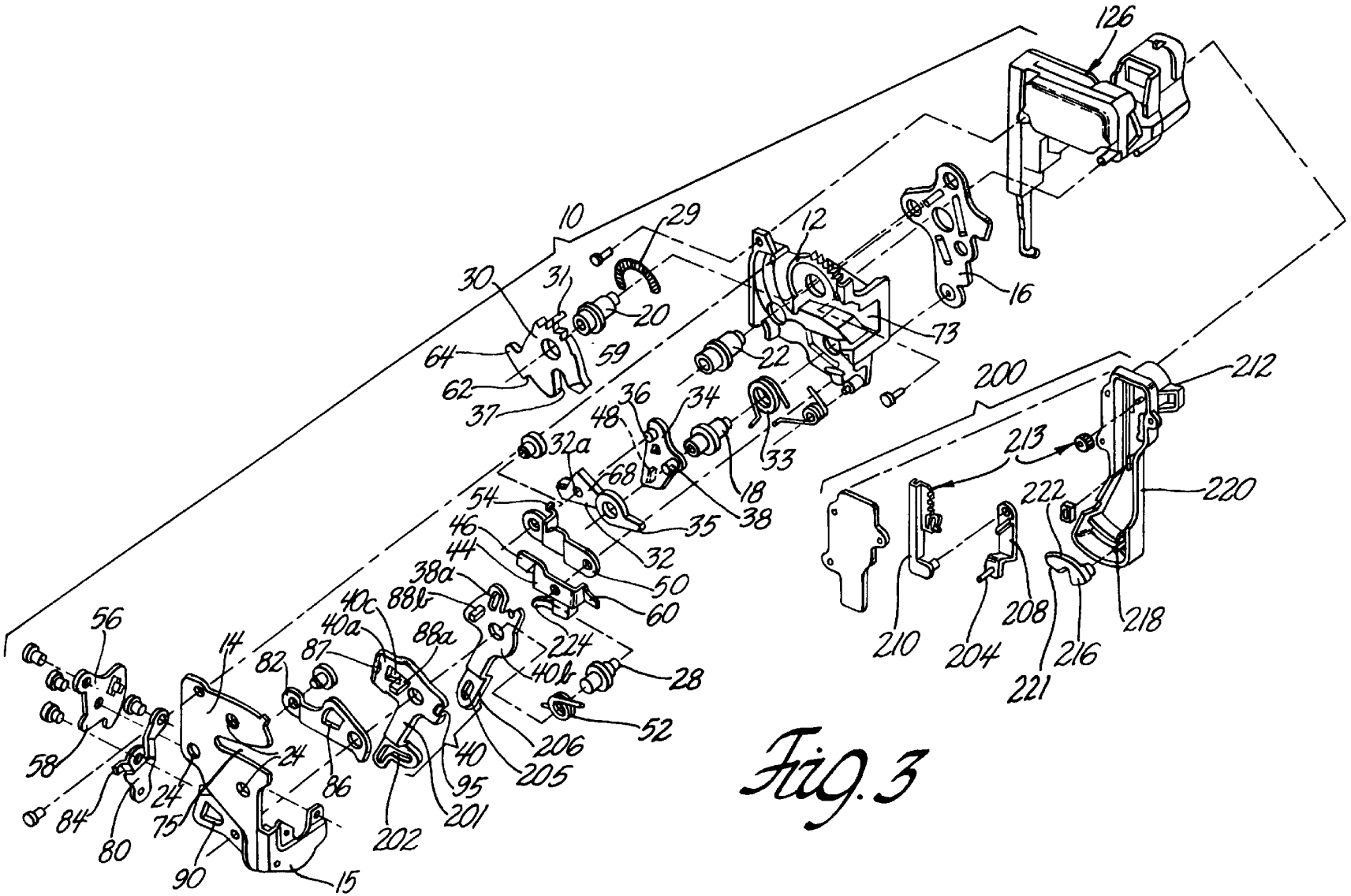
FIG. 3 is an exploded perspective view of the door latch shown in FIG. 1.

Referring now to the exploded perspective view of FIG. 3, the vehicle door latch 10 has a multi-piece enclosure that comprises plastic housing 12, metal faceplate 14 and metal back plate 16. The plastic housing 12 and the metal back plate 16 are held together by three flanged, internally-threaded bushings 18, 20 and 22 that are inserted into three holes in the plastic housing 12, then through three aligned holes in the back plate 16 and then flanged over the back plate. The metal face plate 14 has three bolt holes 24 that are aligned with the bushings 18, 20 and 22 when the metal face plate is attached to the plastic housing 12 by a screw 26. The metal face plate 14 and the metal back plate 16 have lower portions below the plastic housing 12 that are held together by a flanged stud 28 that has projecting pins at each end that are inserted in holes in the plates and peened or headed over.

The Latching Mechanism

The latching mechanism of the vehicle door latch 10 comprises a fork bolt 30 and a cooperating detent 32 that are pivotally mounted on bushings 20 and 18 respectively and located in a chamber of the plastic housing 12 behind the metal face plate 14. The fork bolt 30 is biased clockwise by a coil spring 29. Coil spring 29 is disposed in a curved slot in the plastic housing 12 behind the fork bolt 30, and it engages a depending pin 31 of the fork bolt 30 at one end. Detent 32 is biased counterclockwise into engagement with the fork bolt 30 by a coil spring 33 that surrounds the bushing 18 and that has one end engaging an ear 35 of detent 32. Detent 32 engages fork bolt 30 at shoulder 37 and holds fork bolt 30 in a primary latched position against the bias of spring 29 as shown in FIG. 3. Detent 32 also can engage fork bolt 30 at shoulder 62 and hold it in an intermediate secondary latched position. Detent 32 engages fork bolt 30 at foot 64 in its unlatched position.

The latching mechanism further comprises an intermittent lever 34 for operating detent 32. The intermittent lever 34 is located in the chamber of the plastic housing 12 behind detent 32. It has two integral pivot pins 36 and 38. Pivot pin 36 is journalled in a hole 32*a* in detent 32 so that the detent 32 rotates counterclockwise from the position shown in FIG. 3 (and out of latched engagement with the fork bolt 30) to the unlatched position when the intermittent lever 34 is pulled down. The pivot pin 38 is disposed in a slot 38*a* of a composite locking lever 40 that pivots the intermittent lever 34 clockwise about pivot pin 36 from the unlock position shown in FIG. 3 to a lock position (not shown). The composite locking lever 40 is journalled on the stud 28 between the flange 42 and the faceplate 14. Briefly, the locking lever 40 is rotated counterclockwise to lock the door latch 10 or clockwise to unlock the door latch. Counterclockwise rotation pivots intermittent lever 34 clockwise about pivot pin 36 to a position where it is uncoupled from and out of the path of travel of transfer lever 44 described below. A more complete description of the composite locking lever 40 and locking mechanism is given after the latching mechanism is described.

The latching mechanism further comprises a transfer lever 44 that is journalled on a reduced diameter portion of the stud 28 spaced rearwardly of the flange 42. The transfer lever 44 has an ear 46 at one end that is engageable with an integral, rearwardly projecting tab 48 of the intermittent lever 34 so that the intermittent lever 34 is pulled down when the transfer lever 44 is rotated counterclockwise as viewed in FIG. 3.

The latching mechanism further comprises an outside latch operating lever 50 and a coil return spring 52. The outside latch operating lever 50 is also journalled on the reduced diameter portion of the stud 28 behind the transfer lever 44. It has a bent tab 54 that engages the ear 46 of the transfer lever 44 so that the outside latch operating lever 50 rotates the transfer lever 44 counterclockwise when it is rotated counterclockwise on stud 28. The outside latch operating lever 50 is connected by suitable linkage for rotation by an outside door handle (shown schematically at 116 in FIG. 1).

The coil return spring 52 is disposed around the stud 28 and located between the flange 42 and the transfer lever 44. One end of the coil spring 52 engages the bottom of transfer lever 44 and the other end engages the bottom of the plastic housing 12 above the transfer lever 44 so that the transfer lever 44 and outside operating lever 50 are biased counterclockwise to a rest position where tab 54 engages the bottom of the plastic housing 12.

The latching mechanism further comprises an inside latch-operating lever 56 that is pivotally mounted on a flange 15 of the metal faceplate 14. The inside latch-operating lever 56 has a tab 58 that engages a second ear 60 of transfer lever 44 so that the inside latch-operating lever also rotates the transfer lever 44 counterclockwise when it is rotated clockwise. The inside latch-operating lever is connected by suitable linkage (not shown) for rotation by an inside door handle (shown schematically at 114 in FIG. 1).

Fork bolt 30 has a conventional slot or throat 59 for receiving and retaining a strike member that is attached to the vehicle door pillar to latch the vehicle door in the closed position (not shown). Fork bolt 30 also includes a primary latch shoulder 37, an intermediate secondary latch shoulder 62 and a radially projecting foot 64. Fork bolt 30 preferably has a plastic coating that covers a surface of the slot 59 that is engaged by the striker for energy absorption and quiet operation when the vehicle door is slammed shut.

Detent 32 has a sector-shaped catch 68 that engages the radially projecting foot 64 when the fork bolt 30 is in the unlatched position (not shown). The sector-shaped catch 68 positively engages the primary and latch shoulders 37 and 62 to hold the fork bolt 30 in either the primary or the intermediate secondary latched positions shown in FIG. 2 and not shown, respectively. Detent 32 also preferably includes a plastic coating that has an integral bumper. The bumper engages the bushing 22 to stop counterclockwise pivoting of the detent lever 32 under the bias of spring 33. This bumper also absorbs energy and quiets operation when the door is slammed shut.

The conventional latching mechanism described above operates as follows. When the door latch 10 is in an unlatched and unlocked condition, fork bolt 30 is poised to receive a conventional strike member (not shown) that projects into aligned fish mouth slots 73 and 75 of the plastic housing 12 and the metal face plate 14 when the door is shut. The entering strike member engages the back of the throat 59 and rotates fork bolt 30 clockwise against the bias of spring 29 until fork bolt 30 is rotated to the primary latch position shown in FIG. 3 where fork bolt 30 captures the striker in the throat 59. Fork bolt 30 is held in the primary latch position by catch 68 of detent 32 engaging the primary latch shoulder 37 of fork bolt 30.

Catch 68 rides along the periphery of the fork bolt 30 under the bias of spring 33 as fork bolt 30 rotates clockwise from the unlatched position to the primary latch position shown in FIG. 3. During this travel, catch 68 rides under the foot 64 into engagement with the intermediate secondary latch shoulder 62 and then into engagement with the primary latch shoulder 37. It is to be noted that the engagement of catch 68 with the intermediate secondary latching shoulder 62 is sufficient to hold the vehicle door closed in the event that the vehicle door is not shut with sufficient force so that catch 68 engages primary latch shoulder 37.

The vehicle door latch 10 is not locked so that the vehicle door 100 can be opened simply by operating either an inside or outside door handle (shown schematically at 114 and 116 in FIG. 1) or the like to rotate the transfer lever 44 counterclockwise and the ear 46 down as viewed in FIG. 3. Ear 46 engages projection 48 of intermittent lever 34 and pulls the intermittent lever 34 down from the primary latch position shown in FIG. 3. As the intermittent lever 34 is pulled down, it rotates detent 32 counterclockwise against the bias of spring 52 from the primary latch position shown in FIG. 3. Fork bolt 30 is then free to rotate counterclockwise under the bias of spring 29 from the primary latch position shown in FIG. 3 to an unlatched position as the strike member is pulled out of the aligned fishmouth slots 73 and 75 when the vehicle door is opened.

The Lock Mechanism

The lock mechanism is actuated by a composite locking lever 40 that is divided into an inside locking lever 40*a* and an outside locking lever 40*b* that are journalled on stud 28 between flange 42 and faceplate 14 with inside locking lever 40*a* in front of outside locking lever 40*b*. Counterclockwise rotation of the composite locking lever 40 (when levers 40*a* and 40*b* are coupled together as explained below) rotates intermittent lever 34 clockwise about the pivot pin 36 that is journalled in the detent 32 due to the engagement of the second pivot pin 38 of the intermittent lever 34 in slot 38*a* of the outside locking lever 40*b*. Intermittent lever 34 is thus rotated clockwise from the unlocked position shown in FIG. 3 to a locked position where projection 48 is repositioned out from under ear 46 of transfer lever 44. Consequently, when the door handles or the like are operated so as to rotate the transfer lever 44 counterclockwise to the unlatching position, the ear 46 simply bypasses the projection 48 without transferring any motion to the intermittent lever 34. Consequently, intermittent lever 34 is not pulled down to rotate detent 32 to the unlatch position. In other words, the transfer lever 44 simply freewheels so that operation of the door handles or their equivalent is not effective.

The locking mechanism further comprises an inside lock-operating lever 80 and an outside lock-operating lever 82. Inside lock-operating lever 80 is pivotally mounted on flange 15 of the metal face plate 14 at a location spaced from the pivot for the inside latch-operating lever 56. Inside lock-operating lever 80 has an ear 84 that fits in a slot 85 at one end of inside locking lever 40*a*. Outside operating lever 82 is pivotally mounted on stud 28 in front of locking lever 40. Locking levers 40*a* and 40*b* have protuberances 88*a* and 88*b* respectively that project through a sector-shaped hole 86 in outside lock-operating lever 82 and then through a smaller sector-shaped hole 90 in faceplate 14.

Protuberances 88*a* and 88*b* and sector-shaped hole 90 limit rotation of locking levers 40*a* and 40*b* from an unlocked position shown in FIG. 3 where protuberances 88*a* and 88*b* engage the upper edge of hole 90 to a locked position (not shown) where protuberance 88 engage the lower edge of hole 90.

When inside and outside levers 40*a* and 40*b* are coupled together, composite locking lever 40 is rotated clockwise from the unlocked position shown in FIG. 3 to the locked position by rotating inside lock-operating lever 80 clockwise as viewed in FIG. 3. Inside lock-operating lever 80 is actuated by a suitable actuator assembly (schematically represented by sill button 118 and control rod 120 in FIG. 1).

Figure 2:
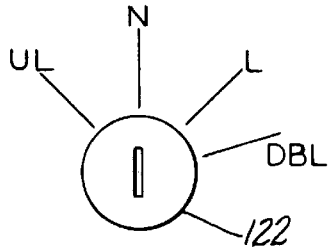
FIG. 2 is a schematic front view of a key lock cylinder shown in FIG. 1.

Composite locking lever 40 can also be rotated clockwise from the unlocked position shown in FIG. 2 to the locked position by rotating outside lock-operating lever 82 clockwise. Outside lock-operating lever 82 is generally actuated by a key lock cylinder through a suitable linkage (schematically represented by key lock cylinder 122 and control rod 124 in FIG. 1). Inside locking lever 40*a* also has a slot 87 for operating the composite locking lever 40 by a linear electric or vacuum motor forming part of power lock actuator 126.

The Deadbolt Lock Mechanism

The vehicle door latch 10 is equipped with a deadbolt lock mechanism 200 comprising the composite locking lever 40 that is divided into an inside locking lever 40*a* and an outside locking lever 40*b*. Inside locking lever 40*a* has an upper yoke with a slot 95 at one end for operation by inside lock-operating lever 80 and a socket 87 at the other end for operation by the linear motor of power lock actuator 126. Outside locking lever 40*b* has a protuberance 88*b* that extends through slot 40*c* of inside locking lever 40*a* and into slot 86 for operation by outside lock-operating lever 82. Inside locking lever 40*a* also has a protuberance 88*a* that extends into slot 86. Outside locking lever 40*b* includes slot 38*a* which engages pivot pin 38 of intermittent lever 34.

Locking levers 40*a* and 40*b* are both pivotally mounted on stud 28 and have pendant straps adapted for coupling or for lost motion. More specifically, inside locking lever 40*a* has a pendant arm 201 with an L-shaped slot 202 in the lower end. Seat 202 is engaged by a drive pin 204 that also engages an elongated radial slot 205 in the lower end of pendant arm 206 of outside locking lever 40*b*. Inside and outside locking levers 40*a* and 40*b* are coupled for concurrent motion when drive pin 204 is located in the radial portion of L-shaped slot 202 and decoupled for lost motion with respect to each other when drive pin 204 is located in the circumferential portion of L-shaped slot 202.

Drive pin 204 is at one end of a link 208 that is pivotally mounted to a slide 210 that is operated by a solenoid 212 through a rack and pinion arrangement 213. Solenoid 212 is controlled by the key lock cylinder (shown schematically at 122 in FIGS. 1 and 2) to position the drive pin 204 in slots 202 and 205.

The position of drive pin 204 is also controlled by a reset lever 216 that is pivotally mounted at 218 to an auxiliary housing 220 for the deadbolt lock mechanism 200. Reset lever 216 has a lower cam surface 221 that is engageable with drive pin 204 and an upper cam surface 222 that is engageable with a cam arm 224 that is attached to the bottom of the transfer lever 44. Reset lever 216 is biased into engagement with cam arm 224 by a torsion spring (not shown).

Figure 4:
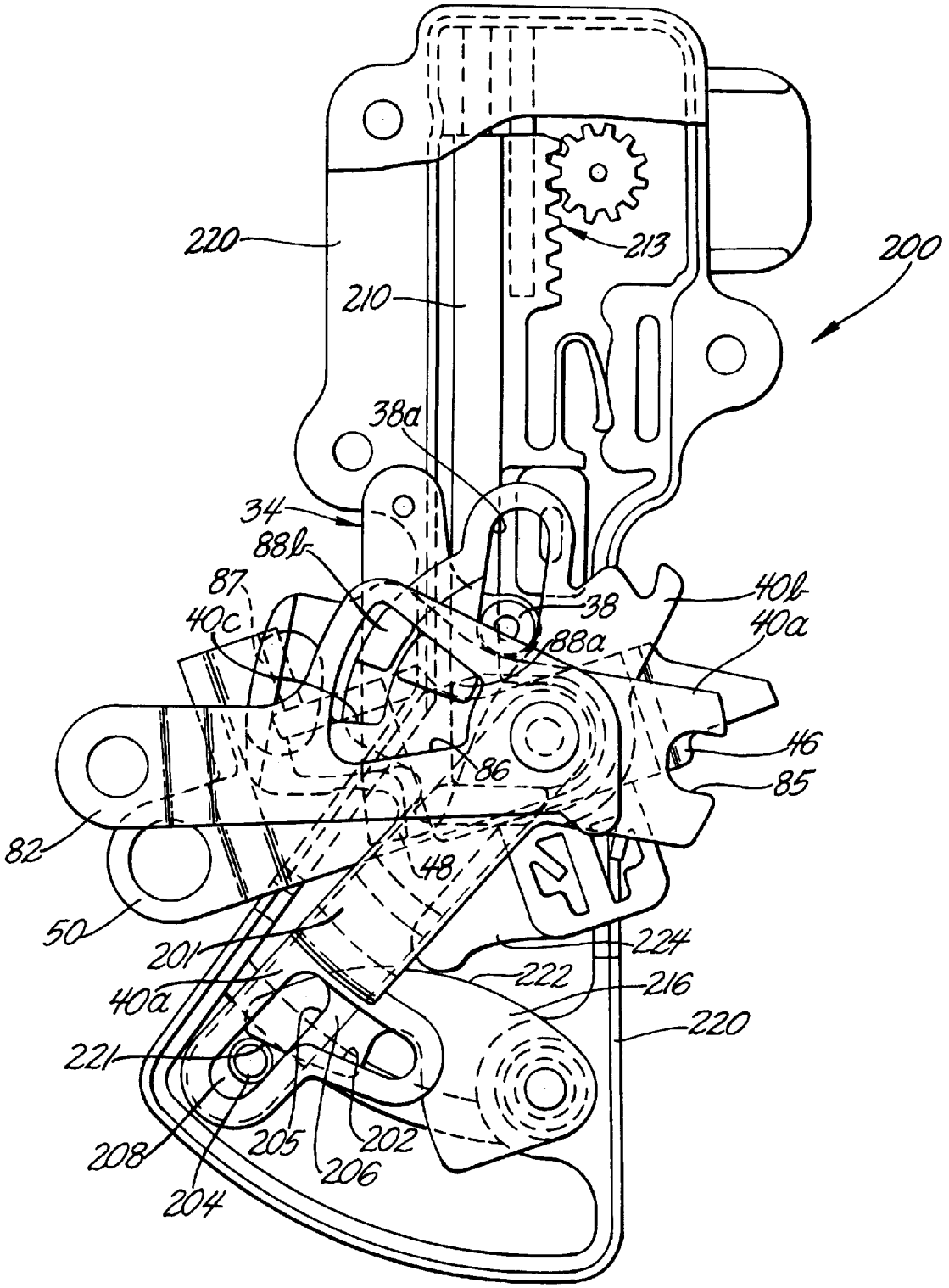
FIG. 4 is a partial front view of the door latch shown in FIGS. 1 and 3 showing the doorlatch in an unlocked and unlatched position.

Referring now to FIG. 4, there is a partial front view of the door latch 10 shown in FIGS. 1 and 3 showing the door latch 10 in an unlocked and unlatched condition with the deadbolt lock disengaged so that the inside and outside locking members 40*a* and 40*b* are coupled for concurrent movement. In this condition, the door latch 10 is unlatched in a conventional manner simply by operating either the inside latch operating lever 56 or the outside latch operating lever 50 to rotate transfer lever 44 counterclockwise from the horizontal latch position shown in FIG. 3 to the unlatch position shown in FIG. 4. This pulls intermittent lever 34 down and rotates detent 32 counterclockwise to release fork bolt 30 as described above. Intermittent lever 34, detent 32 and fork bolt 30 are not shown in FIG. 4 in the interest of clarity.

Figure 5:
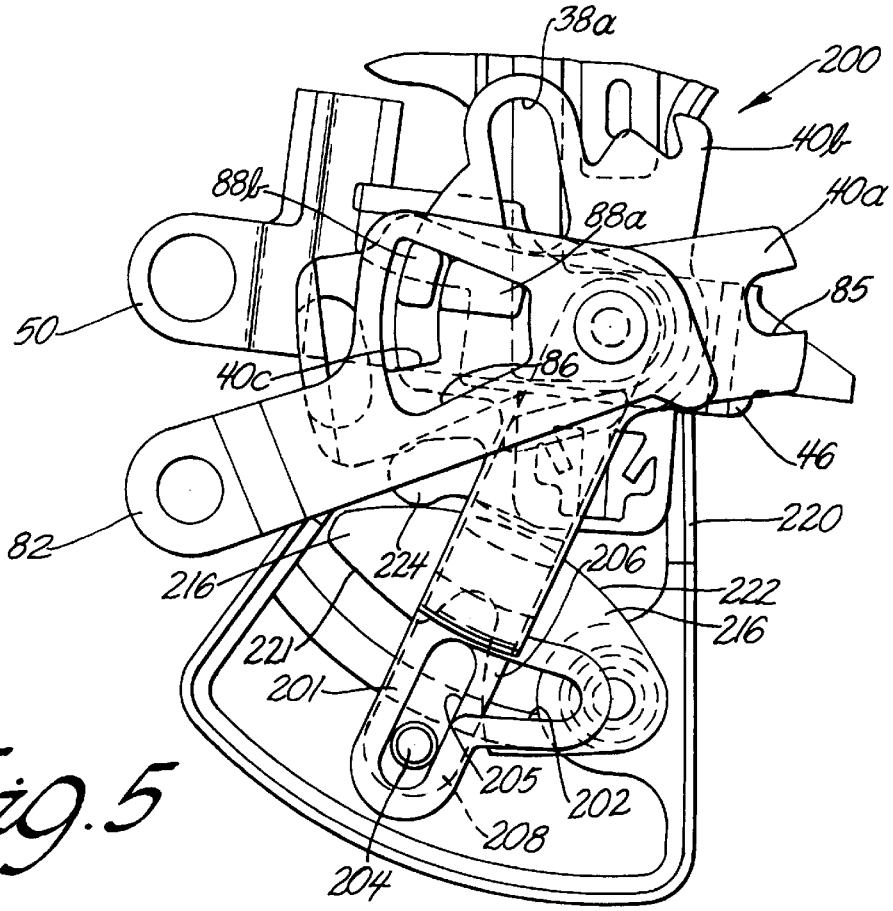
FIG. 5 is a partial front view of the door latch shown in FIGS. 1 and 3 showing the door latch in an locked and latched position.

FIG. 5 is a partial front view of the door latch shown in FIGS. 1 and 3 showing the door latch in a locked and latched condition with the deadbolt lock still disengaged. In this condition, the inside and outside locking levers 40*a* and 40*b* have been swung clockwise from the unlocked position shown in FIG. 4 to the locked position shown in FIG. 5. Locking is accomplished in three different ways. Inside lock operating lever 80 (shown in FIG. 3) or power door actuator 126 is actuated to pivot inside locking lever 40*a* counterclockwise which simultaneously pivots outside locking lever 40*b* counterclockwise which in turn pivots intermittent lever 34 clockwise to the locked position when tab 48 is out of the travel path of ear 46. As a third alternative, outside lock operating lever 82 (shown in FIG. 3) is actuated to pivot outside locking lever 40*b* directly. Note that the locking levers 40*a* and 40*b* are coupled by drive pin 204 so that unlocking as well as locking can be effected from either inside or outside the vehicle.

When the door latch 10 is locked as shown in FIG. 5, the door latch 10 cannot be unlatched even though the deadbolt lock is disengaged because the transfer lever 44 swings past the detent 48 of intermittent lever 34 when the inside latch operating lever 56 or the outside latch operating lever 50 is rotated. However, the door latch 10 can be unlatched in a conventional manner simply by unlocking door latch 10 with any of the three operators described above and then unlatching the door latch 10 as described above in connection with FIG. 4.

Figure 6:
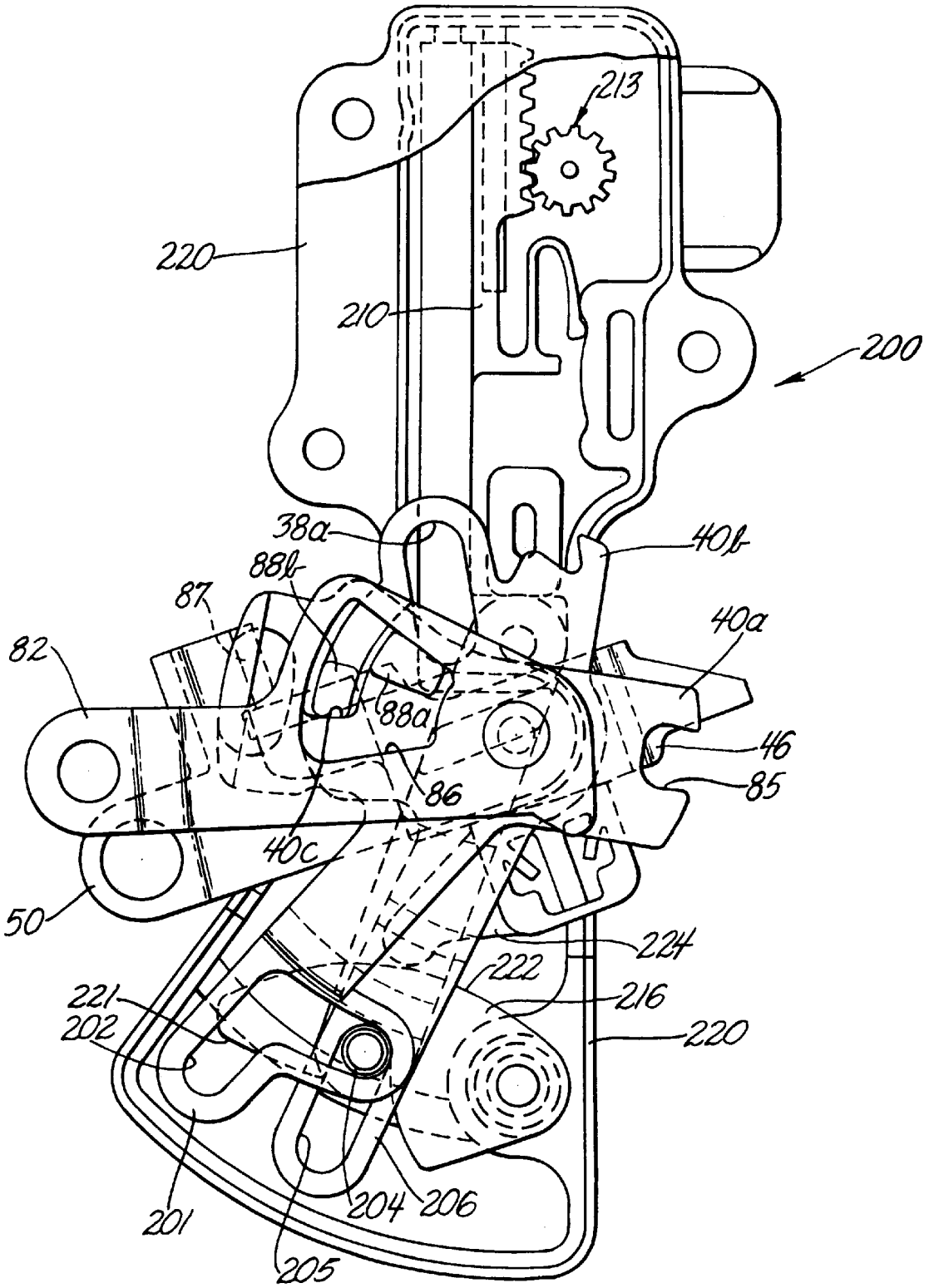
FIG. 6 is a partial front view of the door latch shown in FIGS. 1 and 3 showing the door latch in an locked, dead bolted and latched position.

FIG. 6 is a partial front view of the door latch 10 shown in FIGS. 1 and 3 showing the door latch 10 in a locked and latched condition with the deadbolt lock engaged. Door latch 10 is locked in a well known manner by turning a key in keylock cylinder 122 clockwise from the neutral position N to the lock position L shown in FIG. 2 whereupon the inside and outside locking levers 40*a* and 40*b* are swung to the locked position shown in FIG. 5. The dead bolt mechanism is then engaged in a well known manner by turning the key in the key lock cylinder 122 clockwise past the lock position L to the deadbolt lock position DBL shown in FIG. 2. This energizes solenoid 212 and moves slide 210 and link 208 up so that the drive pin 204 is raised up to the top of slots 202 and 205. Drive pin 204 is now located in the circumferential portion of the L-shaped slot 202 of inside locking lever 40*a* producing a lost motion decoupling of the inside and outside locking levers 40*a* and 40*b* so that door latch 10 cannot be unlocked by the inside lock operating lever 80. When inside lock operating lever 80 is actuated, inside locking lever 40*a* simply freewheels clockwise back to the unlock position, leaving outside locking lever 40*b* and intermittent lever 34 in the locked position as shown in FIG. 5. This deadbolt feature prevents unauthorized vehicle entry, for instance, by breaking the window of a locked and deadbolted vehicle door and unlocking the door latch 10 by the inside lock button shown schematically at 118 in FIG. 1. However, door latch 10 can still be unlocked from outside the vehicle by the key lock cylinder 122 or a remote control device 130 which operates the outside operating lever 82 which acts directly on outside locking lever 40*b* via protuberance 88*b*. FIG. 6 also shows that the deadbolt lock cannot be defeated by the outside door handle shown schematically at 116 in FIG. 1. This is because reset lever 216 cannot push drive pin 204 down when the outside locking lever 40*b* is in the locked position regardless of the position of inside locking lever 40*a*.

The reset member 216 moves the drive member 204 only when the outside locking lever 40*b* is in the unlocked position because of the notch behind cam surface 221. See FIG. 7 as compared to FIG. 6.

Figure 7:
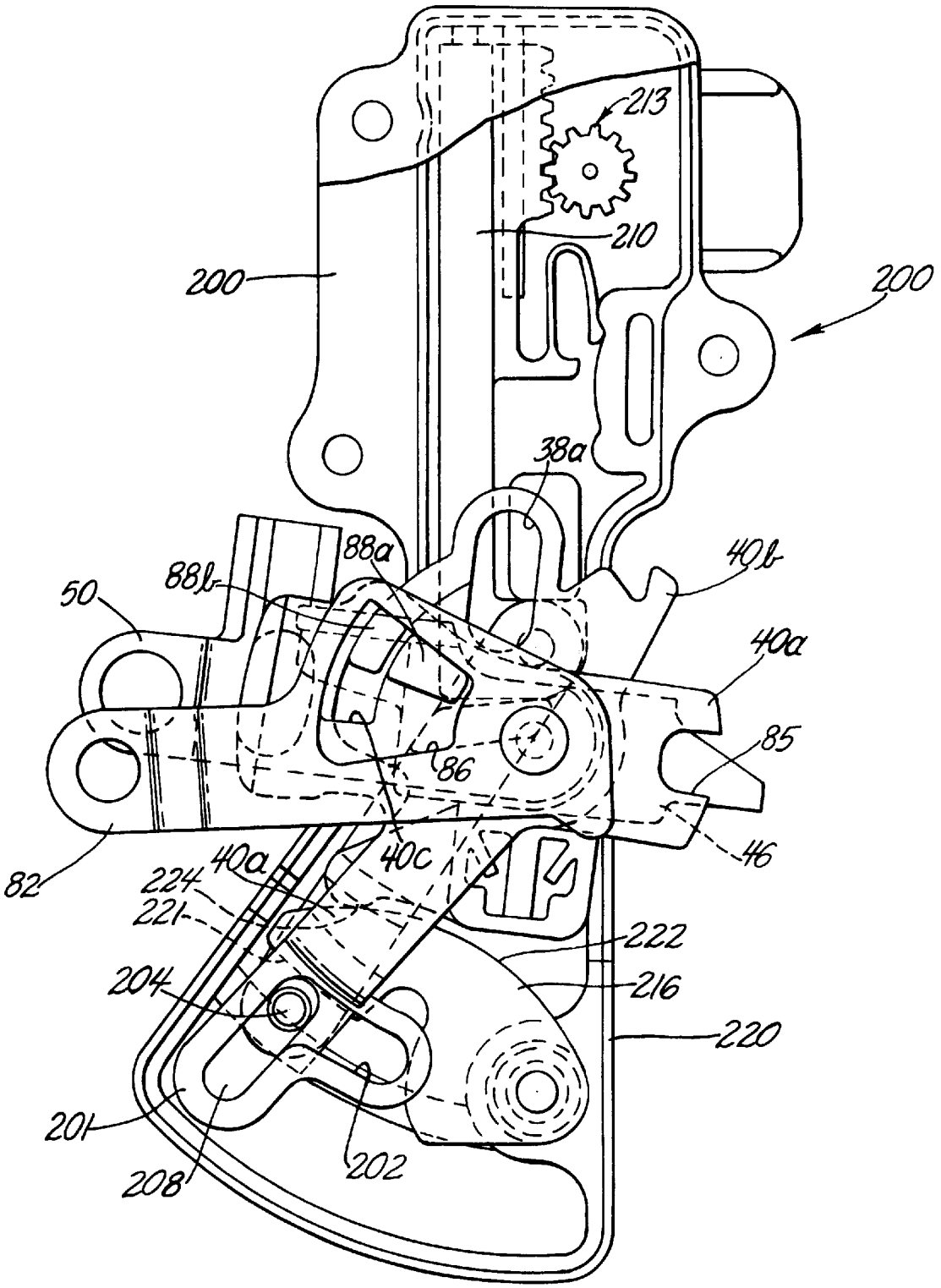
FIG. 7 is a partial front view of the door latch shown in FIGS. 1 and 2 showing the door latch in an unlocked, dead bolted and latched position.

FIG. 7 is a partial front view of the door latch shown in FIGS. 1 and 3 showing the door latch 10 in an unlocked, deadbolted and latched condition. This condition arises when the vehicle door has been closed, the door latch 10 has been locked and deadbolted and electric power has been lost due, for instance, to a dead vehicle battery. When this condition occurs, the door latch 10 is unlocked by turning a key in the key lock cylinder 122 counterclockwise from the neutral position N to the unlock position UL shown in FIG. 2 in a conventional manner which moves the outside locking lever 40*b* clockwise from the locked position shown in FIG. 6 to the unlocked position shown in FIG. 7. Inside locking lever 40*a* is either already in the unlocked position or moved to the unlocked position by outside locking lever 40*b* via drive pin 204 even when drive pin 40*b* is raised as shown in FIG. 7. Door latch 10 is now simply unlatched by lifting the outside door handle 116 which rotates the outside latch operating lever 50 counterclockwise from the latched position shown in FIG. 7 to the unlatch position shown in FIG. 6. Rotation of the outside latch operating lever 50 also rotates unlatching lever 44 and cam arm 224 attached to it counterclockwise from the position shown in FIG. 7 to the position shown in FIG. 6. Cam arm 224 in turn rotates reset lever 216 counterclockwise from the position shown in FIG. 7 to the position shown in FIG. 6. However, since drive pin 204 is beneath cam surface 221, reset lever 216 pushes drive pin 204 down in radial slot 205 and the radial portion of slot 202 coupling the inside and outside locking levers 40*a* and 40*b* together for concurrent movement. This automatically resets the deadbolt locking mechanism in the disengaged position so that door latch 10 can be locked from outside the vehicle using outside locking lever 40*b*.

Many modifications and variations of the present invention in light of the above teachings may be made. It is, therefore, to be understood that, within the scope of the appended claims, the invention may be practiced otherwise than as specifically described.

What is claimed is:

1. A door latch having an outside latch operating lever for unlatching the door latch; a locking lever that has an unlocked position where the outside latch operating lever is operable and a locked position where the outside latch operating lever is disabled; an inside lock operating lever for moving the locking lever back and forth between the locked and unlocked positions and an outside lock operating lever for moving the locking lever back and forth between the locked and unlocked position; and a deadbolt locking mechanism for disabling the inside lock operating lever, the deadbolt locking mechanism comprising:

the locking lever being a composite locking lever that includes an inside locking lever and an outside locking lever, the inside locking lever being operated by the inside lock operating lever and selectively coupled to the outside locking lever, the outside locking lever being operated by the outside lock operating lever and having an unlocked position where the outside latch operating lever is disabled, a drive member that has a drive position that couples the inside and outside locking levers for concurrent movement so that the inside locking lever can move the outside locking lever along with it from the locked position to the unlocked position where the outside latch operating lever is operable and a lost motion position where the inside locking lever cannot move the outside locking lever with it from the locked position to the unlocked position, a link for moving the drive member back and forth between the drive position and the lost motion position, and a reset member that overrides the link for moving the drive member from the lost motion position to the drive position, the reset member being controlled via the outside latch operating lever.

2. The door latch as defined in claim 1 wherein the reset member moves the drive member only when the outside locking lever is in the unlocked position.

3. The door latch as defined in claim 1 further including a cam arm that is moved by the outside latch operating lever and engageable with the reset member, the reset member being controlled via the outside latch operating lever and the cam arm.

4. The door latch as defined in claim 3 wherein the reset member moves the drive member only when the outside locking lever is in the locked position.

5. The door latch as defined in claim 4 wherein the cam arm is on a transfer lever that is moved by the outside latch operating lever.

6. A door latch having an outside latch operating lever for unlatching the door latch, a locking lever that has an unlocked position where the outside latch operating lever is operable and a locked position where the outside latch operating lever is disabled: an inside lock operating lever for moving the locking lever back and forth between the locked and unlocked positions and an outside lock operating lever for moving the locking lever back and forth between the locked and unlocked position; and a deadbolt locking mechanism for disabling the inside lock operating lever, the deadbolt locking mechanism comprising:

the locking lever being a composite locking lever that includes an inside locking lever and an outside locking lever the inside locking lever being operated by the inside lock operating lever and selectively coupled to the outside locking lever, the outside locking lever being operated by the outside lock operating lever and having an unlocked position where the outside latch operating lever is disabled, a drive member that has a drive position that couples the inside and outside locking levers for concurrent movement so that the inside locking lever can move the outside locking lever along with it from the locked position to the unlocked position where the outside latch operating lever is operable and a lost motion position where the inside locking lever cannot move the outside locking lever with it from the locked position to the unlocked position, a link for moving the drive member back and forth between the drive position and the lost motion position, and a reset member that overrides the link for moving the drive member from the lost motion position to the drive position, the reset member being controlled via the outside latch operating lever and moving the drive member only when the outside locking lever is in the unlocked position, and the inside locking lever and the outside locking lever have protuberances that are engaged by the outside lock operating lever as the outside lock operating lever moves from the locked to the unlocked position.

7. A door latch having an outside latch operating lever for unlatching the door latch: a locking lever that has an unlocked position where the outside latch operating lever is operable and a locked position where the outside latch operating lever is disabled; an inside lock operating lever for moving the locking lever back and forth between the locked and unlocked positions and an outside lock operating lever for moving the locking lever back and forth between the locked and unlocked position; and a deadbolt locking mechanism for disabling the inside lock operating lever, the deadbolt locking mechanism comprising:

the locking lever including an inside locking lever and an outside locking lever, one of the inside locking lever and the outside locking lever having a radial slot and the other of the inside locking lever and the outside locking lever having an L-shaped slot, the inside locking lever being operated by the inside lock operating lever and coupled to the outside locking lever by a drive pin that is disposed in the radial slot and the L-shaped slot, the outside locking lever being operated by the outside lock operating lever and having a locked position where the outside latch operating lever is disabled, the drive pin having a drive position in the slots that couples the inside and outside locking levers for concurrent movement so that the inside locking lever can move the outside locking lever along with it from the locked position to an unlocked position where the outside latch operating lever is operable and a lost motion position in the slots where the inside locking lever cannot move the outside locking lever along with it from the locked position to the unlocked position, a link for moving the drive pin back and forth in the slots between the drive position and the lost motion position, and a reset member for overriding the link and moving the drive pin from the lost motion position to the drive position, the drive pin being moved from the lost motion position to the drive position via the outside latch operating lever.

8. The door latch as defined in claim 7 wherein the reset member moves the drive pin only when the outside locking lever is in the unlocked position.

9. The door latch is defined in claim 7 further including a cam arm that is moved by the outside latch operating lever into engagement with the reset member to move the drive pin from the lost motion position to the drive position.

10. The door latch as defined in claim 9 wherein the reset member moves the drive pin only when the outside locking lever is in the unlocked position.

11. The door latch as defined in claim 10 wherein the cam arm is on a transfer lever that is moved by the outside latch operating lever.

* * * * *